US008276220B1

(12) United States Patent
Seymour et al.

(10) Patent No.: US 8,276,220 B1
(45) Date of Patent: Oct. 2, 2012

(54) HEIGHT ADJUSTABLE SEAT

(76) Inventors: Michael Wm. Seymour, Aliso Viejo, CA (US); Carl Evan Tenbrink, Huntington Beach, CA (US)

( * ) Notice: Subject to any disclaimer, the term of this patent is extended or adjusted under 35 U.S.C. 154(b) by 0 days.

(21) Appl. No.: 13/153,684

(22) Filed: Jun. 6, 2011

(51) Int. Cl.
*A47K 3/02* (2006.01)

(52) U.S. Cl. ..... 4/560.1

(58) Field of Classification Search ..... 4/538, 560.1–564.1, 555–556
See application file for complete search history.

(56) References Cited

U.S. PATENT DOCUMENTS 5,978,983 A * 11/1999 Queen et al. ..... 4/556
7,107,630 B2 * 9/2006 Noro et al. ..... 4/556

* cited by examiner

*Primary Examiner* — Lori Baker
(74) *Attorney, Agent, or Firm* — Walter A. Hackler

(57) ABSTRACT

A height adjustable seat for a bath enclosure includes a frame first portion for supporting a person in a sitting position within the bath enclosure and a frame second portion disposed exterior to the bath enclosure. A mechanism for raising and lowering said frame first portion within said bath enclosure a guide system enables adjustment of inclination of the frame first portion as the frame first portion is raised and lowered with the bath enclosure.

5 Claims, 5 Drawing Sheets

HEIGHT ADJUSTABLE SEAT

The present invention generally relates to a bath enclosure system utilizing a height adjustable seat for raising and lowering an individual therein. Many prior art devices, sometimes called bath lift devices, enable a user to enter the bathtub at a full water level and thereafter submerge the user by lowering of the seat. Alternatively, for use with a walk-in bathtub, a seat that can be raised and lowered greatly facilitates the use of such a bath enclosure.

Also to be considered is the fact that such enclosures tend to be quite complicated thus making cleaning of such units a complex and time consuming procedure.

SUMMARY OF THE INVENTION

A height adjustable seat for bath enclosure in accordance with the present invention generally includes a frame first portion for supporting a person in a seating position within the bath enclosure along with a frame second portion disposed exterior to the bath enclosure which includes a mechanism for raising and lowering the frame first portion within the enclosure.

A guide system is provided for adjusting inclination of the frame first portion as the frame first portion is raised and lowered within the bath enclosure. This feature provides a comfort of use for the bather.

More specifically, the guide system may comprise in combination an arcuate surface and at least one wheel of rotatably fixed to the frame first portion for engagement with the arcuate surface. In addition, the first and second frame portions may be interconnected by a hinge which enables pivotable movement of the frame first portion out of the bath enclosure for cleaning thereof.

A linear actuator is provided for coupling of the first and the second frame portions.

BRIEF DESCRIPTION OF THE DRAWINGS

The advantages and features of the present invention will be better understood by the following description when considered in conjunction with the accompanying drawings, in which.

DETAILED DESCRIPTION

Figure 1:
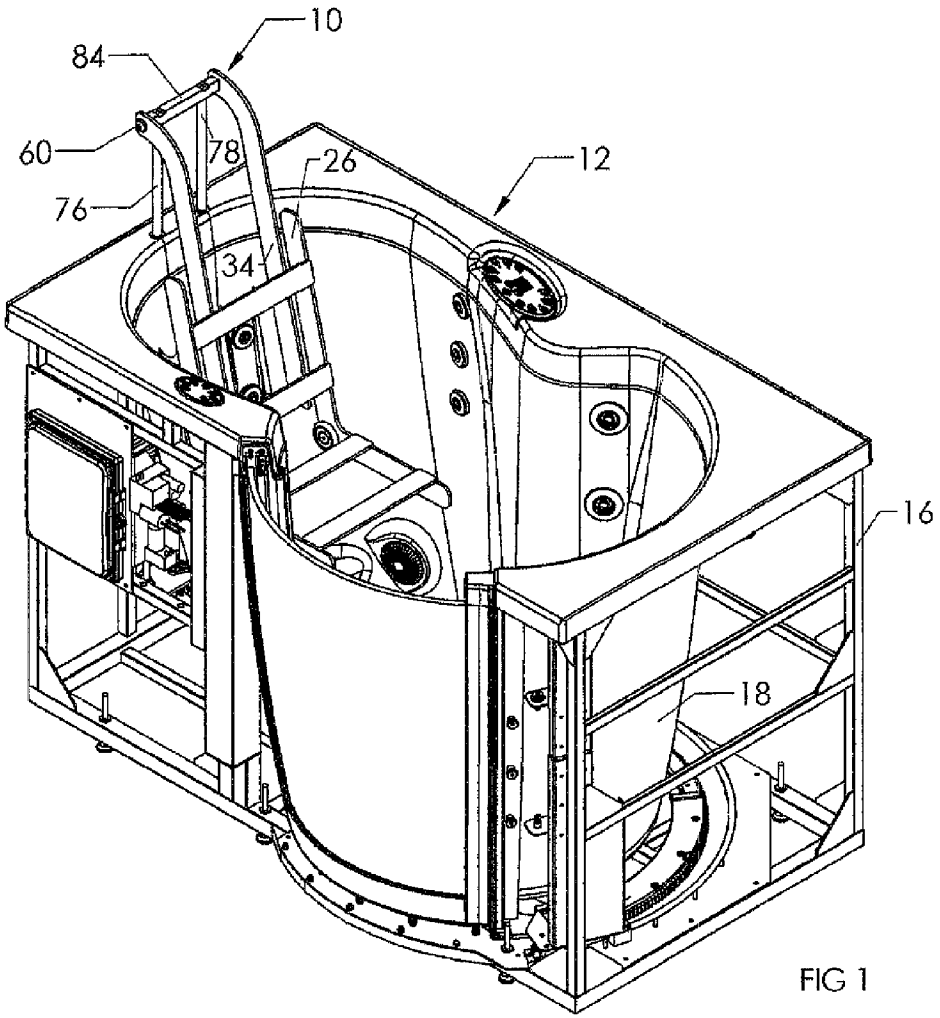
FIG. 1 is a perspective view of a height adjustable seat in accordance with the present invention as it may be installed in a bath enclosure.

With reference to FIG. 1, there is shown a height adjustable seat 10 for a bath enclosure 12, such as, for example, shown in U.S. patent application Ser. No. 12/539,247 filed on Aug. 11, 2009. This application is incorporated herewith in its entirety for illustrating one type of bath enclosure suitable for use in combination with the present invention.

Figure 2:
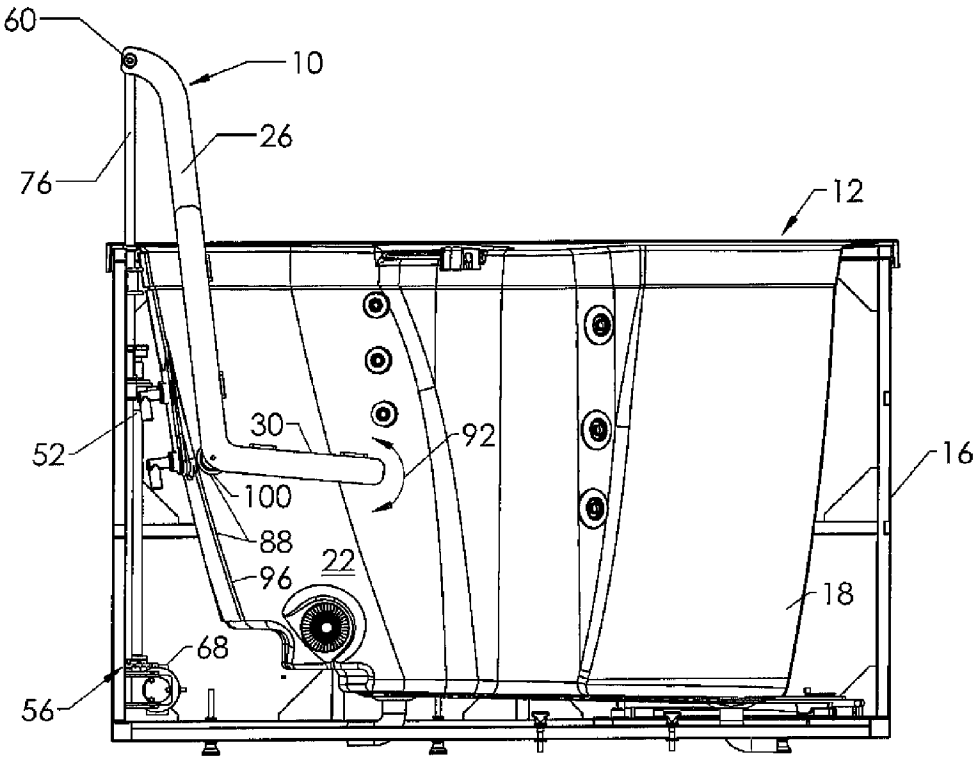
FIG. 2 is a cross sectional view of the invention shown in FIG. 1 with an adjustable height seat being shown in an "up position," along with an arcuate side wall and wheel attached to a frame first portion providing for adjustment of seat inclination.
Figure 3:
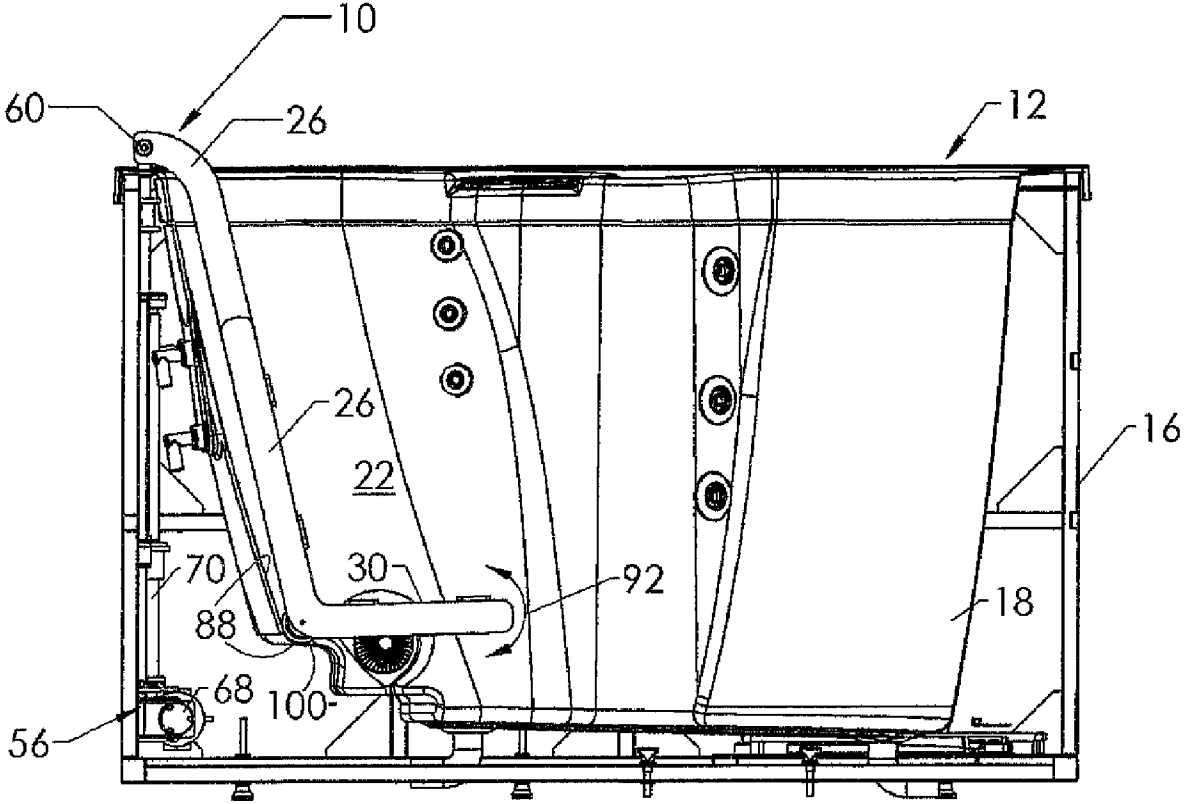
FIG. 3 is a cross sectional view similar to FIG. 2 showing the seat in a "lowered" position.
Figure 4:
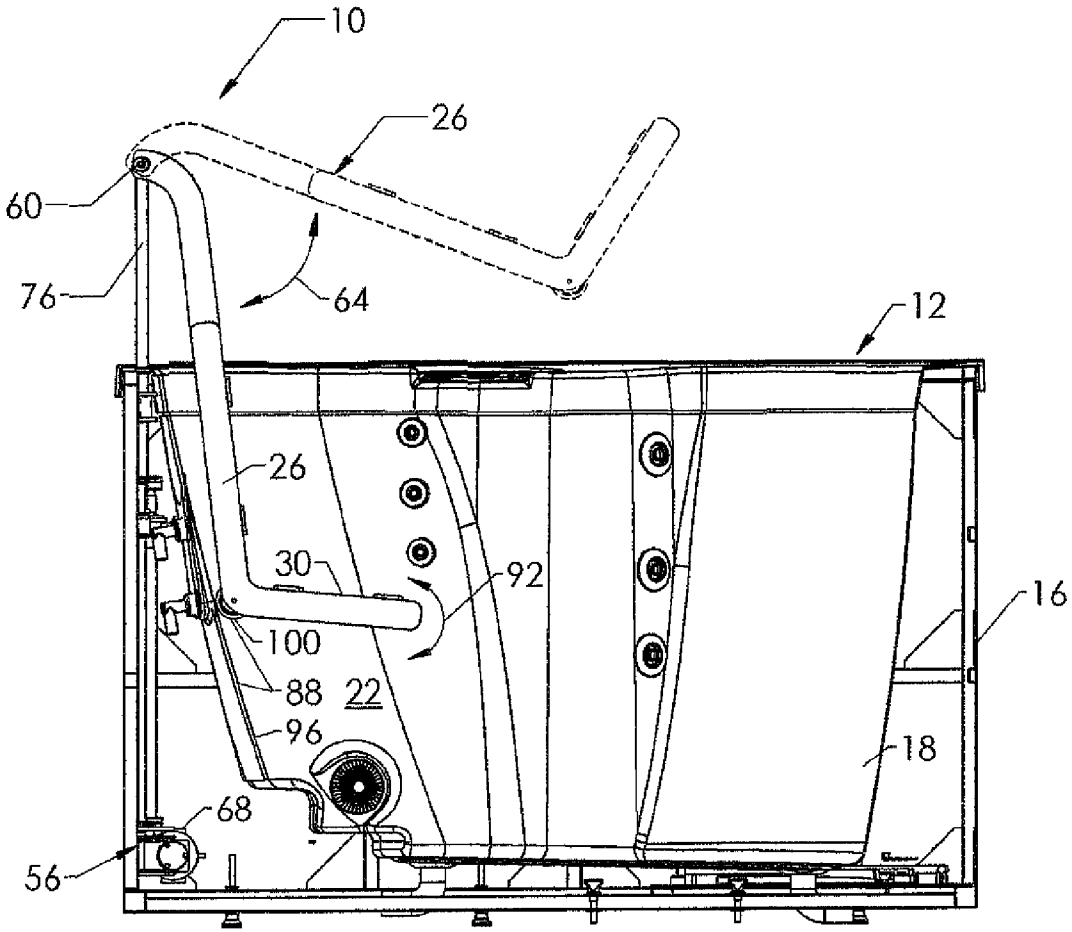
FIG. 4 is a cross sectional view similar to that shown in FIGS. 2 and 3, showing in dotted line, a raised position of the seat from the enclosure for facilitating cleaning of the enclosure.

In that regard, a frame 16 supports a shell 18 for providing a seating area 22 within the bath enclosure 12, see FIGS. 2-4. Other structural features of the bath enclosure 12 are set forth and described in the hereinabove referenced U.S. Patent Application.

With further reference to FIGS. 2-6, the height adjustable seat 10 generally includes a frame first portion 26 for supporting a person, not shown, within the bath enclosure, specifically in the seating area 22.

Figure 5:
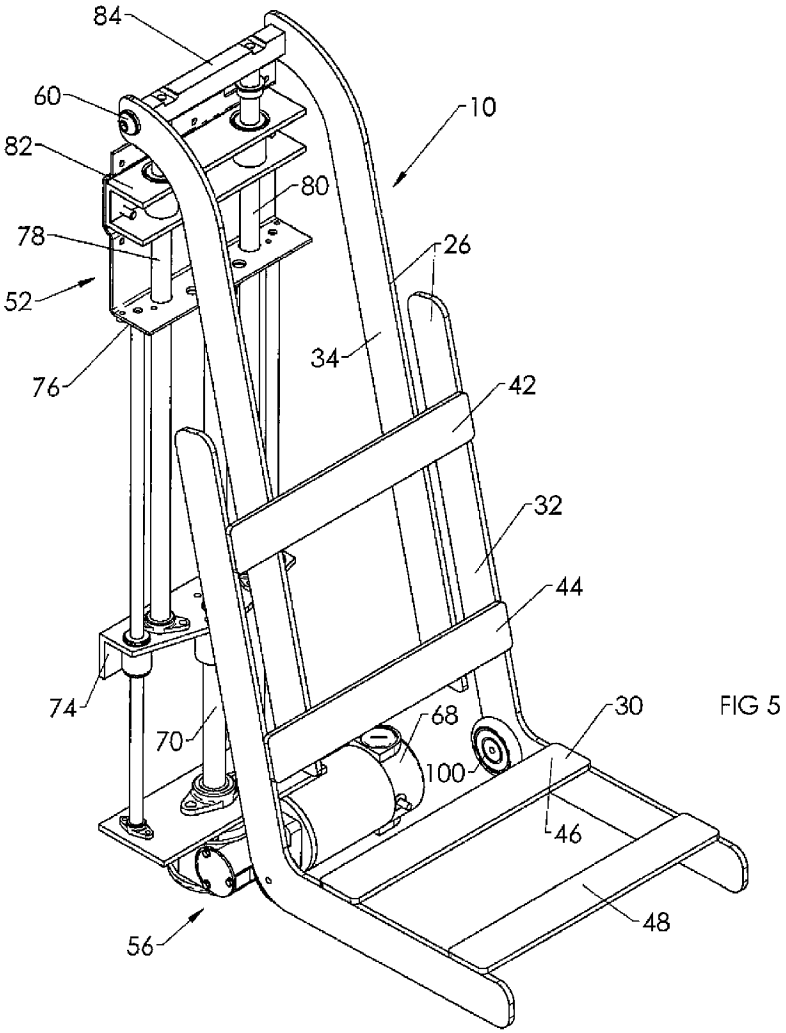
FIGS. 5 is a perspective view of the height adjustable seat in accordance with the present invention and more clearly illustrating the components thereof.

As best shown in FIG. 5, the first portion 26 includes a seat 30 subtending a back 32 attached to stringers 34 of the first portion 26. Any suitable materials of construction may be utilized for assembly of the seat 10, which includes cross pieces 42, 44, 46, 48 for supporting a suitable cushion, or the like, not shown.

As best illustrated in FIGS. 1-4, the height adjustable seat 10 in accordance with the present invention further includes a frame second portion 52 disposed exterior to the bath enclosure 12 which includes, as best shown in FIG. 5, a mechanism 56 for raising and lowering of the first portion 26. Compare FIG. 3 wherein the frame first portion 26 is shown disposed in a bottom portion of the seating area 22 with FIG. 4 illustrating the first portion in a lowered portion.

It should readily be appreciated that the frame second portion 52 and mechanism 56 being disposed exterior to the seating area 22 enables operation of the seat 10 without complex hydraulic system. Importantly, the first portion 26 and second portion 52 are hinged 60 coupled with one another thereby enabling pivoting of the first portion 26 outwardly and out of the enclosure 12 as illustrated by arrow 64 which enables access to the enclosure 12 interior without disassembly or removal of seat 10 from the bath enclosure 12 as illustrated in FIG. 4.

The movement of the first portion 26 is effected by the mechanism 56 which includes a motor 68 and a linear actuator 70 through guide plates 74, 76, 82 and guide rods 78, 80 coupled to a header.

A spreader 84 supports the hinge 60 for pivotal movement between the first portion 26 and second portion 52 as hereinabove described. With reference to FIGS. 2 and 3, a guide system 88 is provided for adjusting the inclination of the frame first portion 26 as the frame first portion 26 is raised and lowered within the bath enclosure 12, as indicated by arrow 92. This adjustment facilitates seating of a person on this seat 30 when the first portion 26 is in a raised position, as shown in FIG. 2, and provides for a more lounge position when the first portion 26 is disposed at a lowered position within the enclosure 12, as shown in FIG. 3. The guide system 88 includes, in combination, an arcuate surface 96 and wheels 100.

Although there has been hereinabove described a specific height adjustable seat in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A height adjustable seat for a bath enclosure, the seat comprising:

a frame first portion for supporting a person in a sitting position within the bath enclosure;

a frame second portion disposed exterior to the bath enclosure and hingeably attached to said frame first portion and including a mechanism for raising and lowering said frame first portion within said bath enclosure; and a guide system for adjusting inclination of the frame first portion as the frame first portion is raised and lowered with the bath enclosure, said guide system comprising in combination, an arcuate surface inside the bath enclosure and at least one wheel rotatably fixed to said frame first portion for engagement with said arcuate surface.

2. The seat according to claim 1 wherein said mechanism comprising a linear actuator operatively coupling the first and second frame portions.

3. The seat according to claim 1 further comprises a hinge interconnecting said first and second frame portions for enabling pivotal movement of said frame first portion into and out of said bath enclosure.

4. A height adjustable seat for a bath enclosure, the seat comprising:

a frame first position for supporting a person in a sitting position within the bath enclosure;

a frame second position disposed exterior to the bath enclosure including a mechanism for raising and lowering said frame first portion within said bath enclosure;

a hinge interconnecting said first and second frame portions for enabling pivotable movement of said frame first position out of said bath enclosure; and a guide system for adjusting inclination of the frame first position as the frame first portion is raised and lowered within the bath enclosure, said guide system comprising, in combination, an arcuate surface inside the bath enclosure and at least one wheel rotatably fixed to said frame first portion for engagement with said arcuate surface.

5. The seat assembly according to claim 4 wherein said mechanism comprises a linear actuator operatively coupling the first and second frame portions.

* * * * *